US005767772A

United States Patent [19]

Lemaire et al.

[11] Patent Number: 5,767,772

[45] Date of Patent: Jun. 16, 1998

[54] MARKER FOR AN ARTICLE WHICH IS DETECTED WHEN IT PASSES THROUGH A SURVEILLANCE ZONE

[76] Inventors: Gerard Lemaire, Villa Santa Lena, 208, Avenue du General Ferric, 06160 Antibes Juan Les Pins; Philippe Lemaire, 2 Chemin d'Amance, 54130 Dommartemont; Patrick Lorelle, 7, rue de la Prairie, 88100 Saint Die, all of France

[21] Appl. No.: 693,478

[22] Filed: Aug. 8, 1996

[51] Int. Cl.[6] ..... G08B 13/14

[52] U.S. Cl. ..... 340/571; 340/572

[58] Field of Search ..... 340/571, 572, 340/568, 693, 551; 174/117 A; 343/788, 895; 333/174; 365/173

[56] References Cited

U.S. PATENT DOCUMENTS

| | | | |
|---|---|---|---|
| 3,478,344 | 11/1969 | Schwitzgebel et al. | 340/825.44 |
| 3,624,631 | 11/1971 | Chomet et al. | 340/539 |
| 3,713,133 | 1/1973 | Nathans | 340/531 |
| 3,848,243 | 11/1974 | Schirmer | 340/517 |
| 4,000,488 | 12/1976 | Ephraim | 340/572 |
| 4,573,042 | 2/1986 | Boyd et al. | 340/539 |
| 4,711,368 | 12/1987 | Simons | 220/450 |
| 4,745,401 | 5/1988 | Montean | 340/572 |
| 4,847,592 | 7/1989 | Esch et al. | 340/572 |
| 4,851,815 | 7/1989 | Enkelmann | 340/571 |
| 5,083,112 | 1/1992 | Piotrowski et al. | 340/572 |
| 5,142,270 | 8/1992 | Appalucci et al. | 340/572 |
| 5,151,684 | 9/1992 | Johnsen | 340/572 |
| 5,456,718 | 10/1995 | Szymaitis | 340/571 |

FOREIGN PATENT DOCUMENTS

| | | |
|---|---|---|
| 0 350 235 | 1/1990 | European Pat. Off. . |
| 2 607 946 | 6/1988 | France . |
| WO 95/12901 | 5/1995 | WIPO . |

*Primary Examiner*—Jeffery Hofsass
*Assistant Examiner*—John Tweel, Jr.
*Attorney, Agent, or Firm*—Sixbey Friedman Leedom & Ferguson; Frank P. Presta; Joseph S. Presta

[57] ABSTRACT

A security device to monitor object displacement and unauthorized removal from an enclosure. A two-layer adhesive is supplied on the marker, the first stronger adhesive for affixing the marker on the object, a second, weaker adhesive with lower tear resistance than the first which modifies an electrical, chemical, or electrochemical feature for detection.

10 Claims, 7 Drawing Sheets

MARKER FOR AN ARTICLE WHICH IS DETECTED WHEN IT PASSES THROUGH A SURVEILLANCE ZONE

This invention relates to security devices monitoring object displacement and unauthorized removal from an enclosure, and more particularly relates to markers, e.g. in the form of labels, for the objects to be monitored.

There are three types of radiofrequency-operated protective labels: passive labels, active labels without an energy source, and active labels with an energy source.

Passive labels usually comprise a resonant circuit capable of oscillating at a single frequency, i.e. the frequency of the circuit. When situated in a radiofrequency field, the label absorbs energy and a sensor measuring the energy absorbed signals the presence of the label.

Most security devices in use to date use markers of this type. They are detected when they pass between antennas located in surveillance zones, e.g. near the exits from the enclosure to be monitored.

These systems are not entirely infallible because the label need only be separated from the article before it leaves the store for the stolen article to go undetected.

As a result, use is made of increasingly bulky markers which are increasingly difficult to remove from the article to which they are attached without specific implements that enable them to be removed without damaging the article thus marked.

Furthermore, these markers preserve their ability to detect the object to which they are attached as long as they remain attached thereto, so that they remain detectable even after authorized passage through the surveillance zones, i.e. even after the objects have been duly acquired. In many instances the purchaser of an article in one store will have said article detected upon leaving a second store, thereby triggering the speedy arrival of security services.

Active labels are labels comprising an electronic circuit capable of interacting with an interrogation system. Data contained in the electronic circuit can be read, other data can be written or existing data can be modified.

Active labels without an energy source contain a small transmitter which obtains its energy from the interrogation system by means of a small antenna situated on the label. The range of these labels is limited due to the low power transmitted by the radiofrequency coupling, the performance thereof varies according to the environment in which they are placed and the way they are oriented in relation to the interrogation system.

Active labels with an energy source such as those disclosed in French patent No. FR 2,607,946 enable these problems to be remedied. Such a label can inform the interrogation system of its passing close to a door detector or portable detector, or of the fact that it has been torn off the article to which it is attached by a detection loop.

Such a label can however be removed from the article by an individual who does not hesitate to make a slit in the article to free said protection loop.

The development of this type of label was hindered for a long time by the fact that energy sources were either too expensive or too bulky to be used in these labels. The label described in the above-mentioned French document comprises a battery known as a button battery, thus requiring the shaping of a case approximately 5 mm thick.

Documents WO 95/12901 and EP 0.350.235 describe energy sources enabling these problems to be overcome.

The known devices, despite the fact that they provide numerous solutions to the problems involved in monitoring articles on show, do not provide infallible security. In particular, in the field of adhesive labels, whether active or passive, the systems are all easily destroyed by laceration or by power cutoff.

This invention tends to provide a marker such that it cannot be destroyed, or disassembled from the article on which it has been placed, without transmitting an alarm signal.

To this end, it relates to a marker comprised of a label bonded to the article to be monitored and which cannot be removed from the article or destroyed by tearing or laceration without transmitting an alarm signal, this label being susceptible of being used as a passive label or as an active label, with or without its own energy source.

Accordingly, the invention relates to a marker intended to be detected when it passes through the surveillance zones and to immediately transmit an alarm signal when an attempt is made to remove it from the article to which it is attached, of the type comprising an electronic circuit with an electronic module and a detecting means of which one electric, chemical or electrochemical feature is modified when an attempt is made to remove said marker from the article to which it is attached, and an electronic module capable of detecting the modification in the detecting means and of informing the monitoring means thereof, e.g. by means of an antenna, characterized in that it comes in the form of an adhesive label comprising a bottom layer bearing an adhesive by way of which it is applied to the article to be protected, and a peel-off layer fixed to the bottom layer by an adhesive with lower tear resistance in order to ensure that the latter adhesive yields first when an attempt is made to remove the label from the article to which it is attached, thereby leading to a tearing of the peel-off layer while the bottom layer remains fastened to the article, and in that the detecting means is disposed between the peel-off layer and the bottom layer so that its electric, chemical or electrochemical feature is modified when the peel-off layer is torn off.

The invention is elucidated in the following description given, by way of a non-limiting example, in reference to the corresponding accompanying drawings in which:

FIGS. 1 to 3 schematically represent three embodiments of a marker comprising an electronic circuit;

FIG. 4 is a partial sectional view of a label embodying the invention, located on an article;

FIGS. *5a* to *5e* show the different stages in the manufacturing of another embodiment of the label according to the invention;

Figure 1:
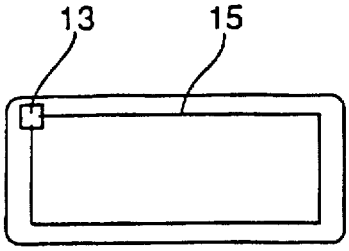

As represented in FIG. 1, the invention relates to a marker of the type comprising an electronic circuit with an electronic module 13 and a ring 15 for detecting attempted fraud.

The electronic module is selected so that it is appropriate to the commands requested of it, and may include one or more electronic chips and/or surface components.

The conductor 15 forming the detector ring is very fine and can be easily broken. Its surface may be large but it must be very thin in order for it to be tearable.

This conductor 15 can be used to feed the electronic module 13 with electric power by subjecting the marker to an energy field, preferably a radioelectric field. In the surveillance zone, such a field induces, in the conductor 15, a current that shall be rectified in known manner to power said electronic module.

While the markers are predominantly though not exclusively intended to mark articles for sale in stores with a view to the monitoring thereof, they may also be used in museums and other exhibition sites.

As the monitored zones are usually enclosed areas, it is therefore very easy to set up radioelectric fields within them to power the markers embodying the invention.

In the case of large-area stores or exhibition halls, the field set up by the lighting therein may suffice to power the markers embodying the invention and thus eliminate the need for special power sources.

By suitably selecting and programming the electronic module on the marker embodying the invention, this marker may also interact with a stock and/or price monitoring circuit. For that purpose, an electronic module capable of storing data and of transmitting and/or receiving data shall be used, either by itself or via an antenna.

In this embodiment, the detector ring 15 serves as antenna.

In another embodiment, the digital signals emitted by the electronic module are coded in order for them to be easily distinguishable from other external noise signals.

The marker embodying the invention is intended to operate on premises equipped with surveillance systems typically used for exit control, and with surveillance systems ascertaining attempted pilfering within the premises.

This attempted pilfering consists of attempting to remove the marker from the object to which it is attached, or to render it inoperative by laceration, scratching, tearing, etc.

According to the invention, the electronic circuit mounted in the label emits a signal as soon as any unauthorized person attempts to remove the label from the article to which it is attached or attempts to damage the label in order to render it inactive.

This attempt to remove the marker is detected by means of the detector ring 15 and it is for this reason that the conductor used evinces a very slight cross-section to render it frail and to allow breaking of its electric continuity as soon as the attempt is made to remove the marker from the article to which it is attached.

According to the invention, the marker comes in the form of an adhesive label intended to be bonded to an article for sale or on exhibition.

With such a marker bonded over its entire area to the protected article, said article cannot be cut into for the purpose of removing the marker in order to steal said de-marked article as the latter would be too damaged to be used.

The only way to procure said article without danger of being detected within the control zones is to detach said label.

As will be described hereinafter, the marker embodying the invention is such that any endeavour to detach the label from the article to which it is attached breaks the electric continuity of the detector ring.

This rupture of the electric continuity in the detector ring 15 is at once sensed by the electronic module which accordingly transmits a signal which is picked up and analyzed by the monitoring equipment spread over the premises.

In the embodiment represented in FIG. 1, the conductor forming the detector ring 15 is used as the antenna transmitting said signal.

By way of the label embodying the invention, the surveillance team is immediately alerted to this pilfering attempt.

Once the attempted pilfering signal has been emitted, the marker according to this embodiment can no longer be powered and becomes mute on the premises.

As will be described hereinafter, in a preferred embodiment, the label is such that the electronic module remains affixed to the article after the label has been torn off and is detectable by the surveillance systems located in the store exit zones to provide a second way of intercepting any thief who believes the article marker has been got rid of.

According to the invention, the label consists of several peel-off layers so that the detector ring 15 is borne on an outer side of said label and thus will easily rupture and is removed from the article bearing the marker, whereas the electronic module remains bonded to the article.

Figure 2:
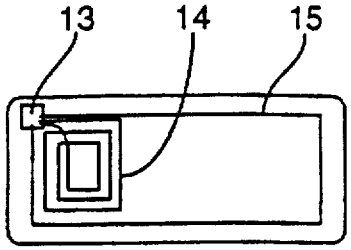

In the embodiment represented in FIG. 2, the marker comprises a transceiving antenna 14 in addition to the detector ring 15.

This form of embodiment enables the electric power supply to the electronic module to be continued even after the rupture of the detector ring 15, provided said antenna is not destroyed.

It is then possible to continue to interact with said electronic module after the detection of attempted fraud, e.g. in order to identify the article and/or to locate it within the monitored zone.

Figure 3:
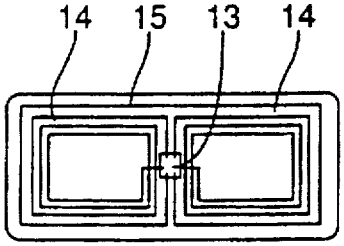

FIG. 3 represents another embodiment of a marker in which two transceiving antennas 14 are provided in order to increase the chances of preserving an antenna capable of transmitting information after attempted tearing off of the label.

The number of antennas can, of course, be increased provided the dimensions of the label so permit. These antennas can be mounted on separate peel-off layers so that when one layer is torn off, the remaining layers continue to function.

Figure 4:
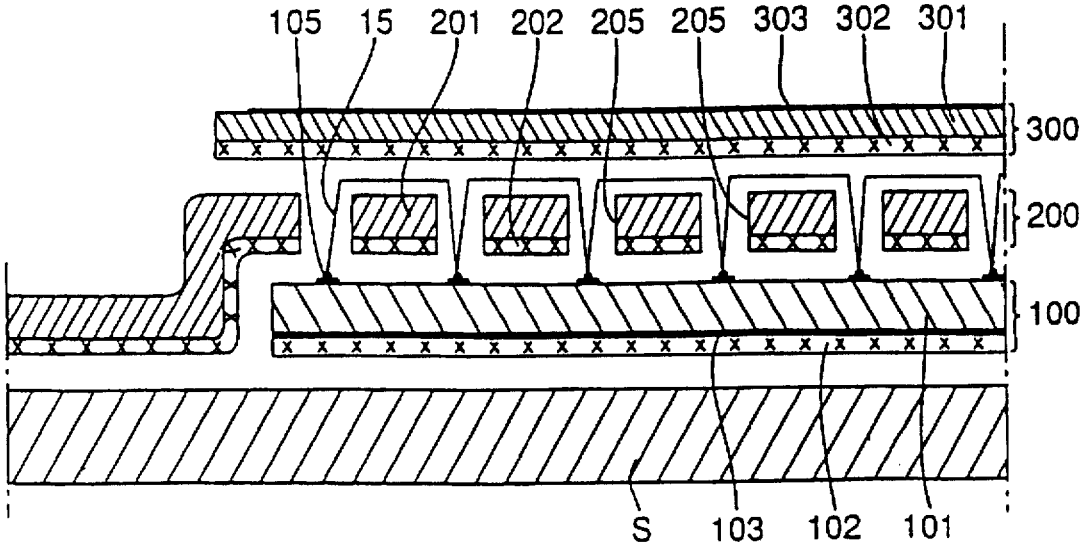

The composition of a label embodying the invention can be seen in FIG. 4 where it is represented bonded to a substrate S constituted by the article to be marked.

The label is comprised of layers 100, 200, 300 arranged on top of one another.

The bottom layer 100 is comprised of a substrate 101, e.g. constituted by a sheet of plastic, and an adhesive 102 by way of which it is applied to the article to be protected (symbolized by the substrate S).

The peel-off layer 200 is also comprised of a substrate 201 and an adhesive 202. This layer is referred to in this instance as the peel-off layer as, according to the invention, the adhesive 202 affixing it to the bottom layer 100 is less resistant to tearing off than the adhesive 102. This arrangement ensures that the adhesive 202 yields first when an attempt is made to remove the label from the substrate S to which it is attached, thereby causing a tearing off of the peel-off layer 200 while the bottom layer 100 remains affixed to the substrate S.

The electronic module and the vital elements required for communication with the monitoring means, e.g. its energy source and the transceiving antennas when the latter are provided, can be located in one or other of the layers 100 or 200. However, they will preferably be located in the bottom layer 100 in order to remain on the article after the label has been destroyed and to continue to protect it by enabling the surveillance systems to locate the article or to identify it at the exits from the enclosure.

When the module is positioned in the peel-off layer 200, the label only enables attempted removals to be monitored.

The detecting means, constituted in the embodiment in FIG. 4 by a loop of conducting wire 15, is disposed in such a way that it is connected to the two layers 100 and 200 in order to be destroyed when the peel-off layer 200 is torn off.

The loop of conducting wire 15 represented in FIG. 4 is disposed on the non-adhesive upper side of the peel-off layer 200 and passes through openings 205 in said peel-off layer 200 in order to be made integral at 105 with the bottom layer 100.

In the form of embodiment represented, the peel-off layer 200 has a larger area than that of the bottom layer 100 so as to completely cover said bottom layer 100 and to be bonded to the substrate S at a zone surrounding the bottom layer 100. This form of embodiment ensures that an attempt to remove the label from the substrate will lead to a separating of the layers 100 and 200 as only the layer 200 is accessible from without.

The label represented in FIG. 4 further includes a top layer 300 formed on a substrate 301 and an adhesive 302 to affix it to the peel-off layer 200. This layer 300 is not indispensable to the operation of the label according to the invention. It enables the wire 15 to be protected in order to avoid the latter being destroyed unintentionally by a purchaser taking the object to examine it, or to try it on in the case of an item of clothing. It also enables ill-intentioned people to be outwitted if covered by a printed layer 303 specifying commercial data such as the sale price or a decoration leading to believe that the label merely serves informative and decorative ends. If made integral with the peel-off layer 200, it can also constitute a triggering element in the case of attempted laceration or scratching, as the wire 15 will be cut if it is destroyed or torn off.

The manufacturing stages of a marker of this type are shown in illustrative manner in FIGS. 5*a* to 5*e*.

Figure 5A:
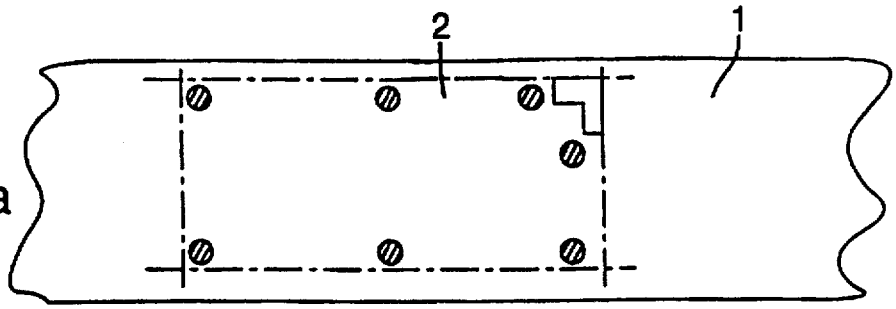

In the first stage shown in FIG. 5*a*, a first blank 2 assuming approximately the shape of the label to be manufactured, but preferably smaller, is cut out of a tape of material 1, e.g. polystyrene, PVC or ABS. This blank 2 is intended to form the bottom layer of the label.

Figure 5B:
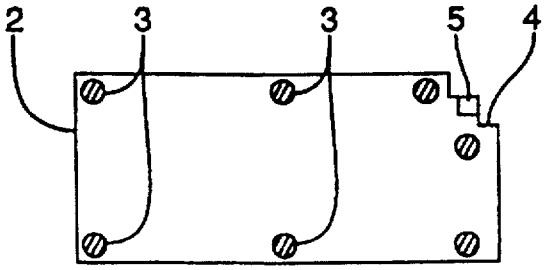

As shown in FIG. 5*b*, one of the blank corners evinces an L notch. Metallized, conducting and illustratively circular portions 3 are formed on this first blank 2 and are located near the periphery, and an electronic module 5 is affixed to the concave edge of said notch.

As a variation, plural metallized portions can be formed to cover the entire surface including the center, in which case the conductive ring is mounted in zigzag or spiral form.

Figure 5C:
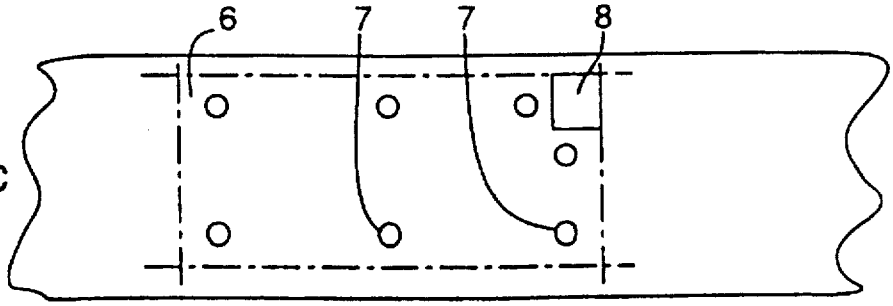

A second blank 6, intended to form the peel-off layer of the label, is also cut out of the tape of material in the stage shown in FIG. 5*c*.

Figure 5D:
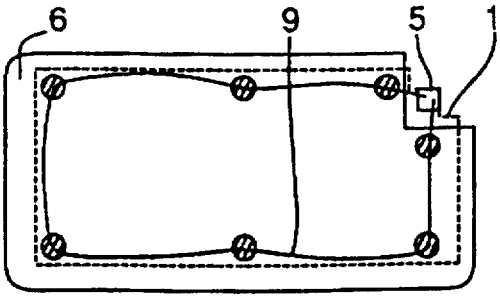
Figure 5E:
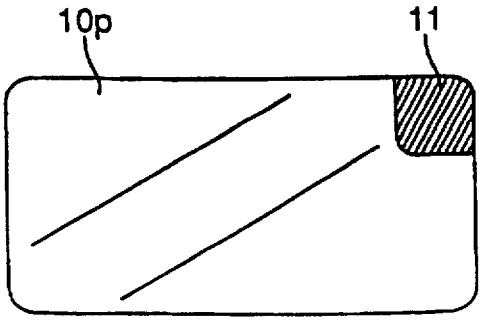

This second blank 6 comprises a notch 8 in the corner corresponding to that of the electronic module of the first blank 2 and furthermore comprises apertures 7 arrayed opposite the metallized portions when the two blanks 2 and 6 are mounted on each other as shown in FIG. 5*d*.

Once the two blanks have been positioned one on the other with the apertures 7 opposite the metallized portions 3 and after the they have been joined by an adhesive layer, the detector ring 9 is formed by placing conductive strips on the second blank 6 which is itself on the first blank 2, said strips being connected to the metallized portions 3 of said first blank 2.

Thereupon the electronic module is cast into a stub 11 and a layer of adhesive covered by a protective sheet is affixed to the back of the label, i.e. to the side of the blank 2 not covered by the blank 6.

Said blanks 2 and 6 are bonded to each other by an adhesive with an adhesion less than that on the back of the label.

When an attempt is made to remove the label 10 thus manufactured and glued to an object, the blank 6 at the top will come off whereas the blank 2 remains bonded to the object and the continuity of the detector ring will be broken.

In this form of embodiment, the blank 6 may bear useful data such as price, bar code, whereas decorations may be printed or embossed on the lower blank 2. The purchaser of the article may then take off the upper blank 6 and leave the lower blank 2 on the article to preserve the adornment.

Obviously too the marker according to the invention allows customers in good faith, who do not intend to remove the label, to examine the article, to try it on if it is an item of clothing, to put it back, without triggering the surveillance system.

When the label-bearing article is properly moved to a cash register in the store, a coded electric signal will be induced in the electronic circuit by means of the detector ring operating at that time as an antenna. This signal is powerful enough to evaporate a fuse. This must be a fuse integrated in known and conventional manner into the electronic module. This destruct-signal may be emitted at the time of reading the bar code on the label defining this article and its price.

Because an electronic module is used, the effective fuse destruction may be checked before validating price entry, as a result of which the marker embodying the invention can be deactivated.

It is also possible to deactivate the label by sending the electronic module an instruction signifying stoppage of its operation, said instruction being durably stored in a memory of the electronic module. Accordingly, the label embodying the invention is made inoperative once the article has properly left the store and thereby this article will go undetected by other surveillance systems through which it may be carried after payment. However, subsequent to being deactivated, it may still be queried as regards the type and/or features of the product by memorization of an electronic instruction.

The energy storage of such a label may be increased by using a capacitor in the electronic circuit, such a capacitor being preferably produced by direct printing or by superimposition of conductive layers. This capacitor is housed between the substrate 101 and the adhesive 102, in the layer bearing the reference 103 in FIG. 4. The capacitor can also serve as a back-up energy source when the main source is too weak or inoperative at the time of the attempted theft.

Additional frailty-enhancing means such as rupture lines may be further provided in the label. More particularly, they will be formed in the peel-off layer 200 and top layer 300 when the latter exists, to increase the likelihood of rupture by causing the label to tear in several places, thereby reliably and inevitably entailing rupture of the detector ring 15.

Obviously, the above description is merely given by way of an example, the label embodying the invention being also applicable elsewhere, e.g. for identifying people or objects passing triggering means, processing more or less bulky parcels in the postal service, luggage at airports, waste bags in refuse stations, etc.

The labels embodying the invention thus enable both the identification of people and objects, detection of pilfering or attempted fraud such as the transferring of a label from an authorized to an unauthorized person, the tearing off of a label to steal parcels, and said label can be made inoperative when the person or object to which it is attached leaves the zone under surveillance.

The electronic module can be fitted with a memory enabling useful data to be stored, and with a microprocessor to process these data in conjunction with external means. The markers embodying the invention can be used e.g. to sort parcels.

In a variation for specific applications, external contacts can be provided on the label to allow further interaction with adequate reading means like chip cards.

The use of a tape of material is, of course, described by way of an example and the labels too may be made from any other substrate such as a plate from which the labels would be cut out in a sequence of columns.

As can be seen in FIGS. 2 and 3, when one or more antennas 14 are provided in the label, the detector ring 15 is located on the label periphery in order that it may be destroyed before there is danger of damage to the antenna(s) 14.

The antennas 14 can be laminated into the label body to ensure they remain intact during detachment, e.g. in the layer referenced 103 in FIG. 4.

The signal emitted by the electronic module of a marker embodying the invention can be a simple alarm signal, but can also convey data stating the exact type of the object in question and the type of alarm detected.

In the exit zone, a monitoring means similar to the means commonly used to date ensures the detection of any object bearing a label, whether the latter is a complete label or just the remaining part bearing the electronic module.

The use of an electronic module with which the detecting means can interact avoids unwarranted detection in the exit zones.

The stub enclosing the electronic module can be cast from a transparent material in order to enable data to be transmitted by luminous signals.

In a known manner in the field of moulding plastic articles, said markers can be decorated during moulding, over their entire surface or just part thereof, or can be subsequently decorated on request as a function of the intended use(s) of the markers.

Figure 6:
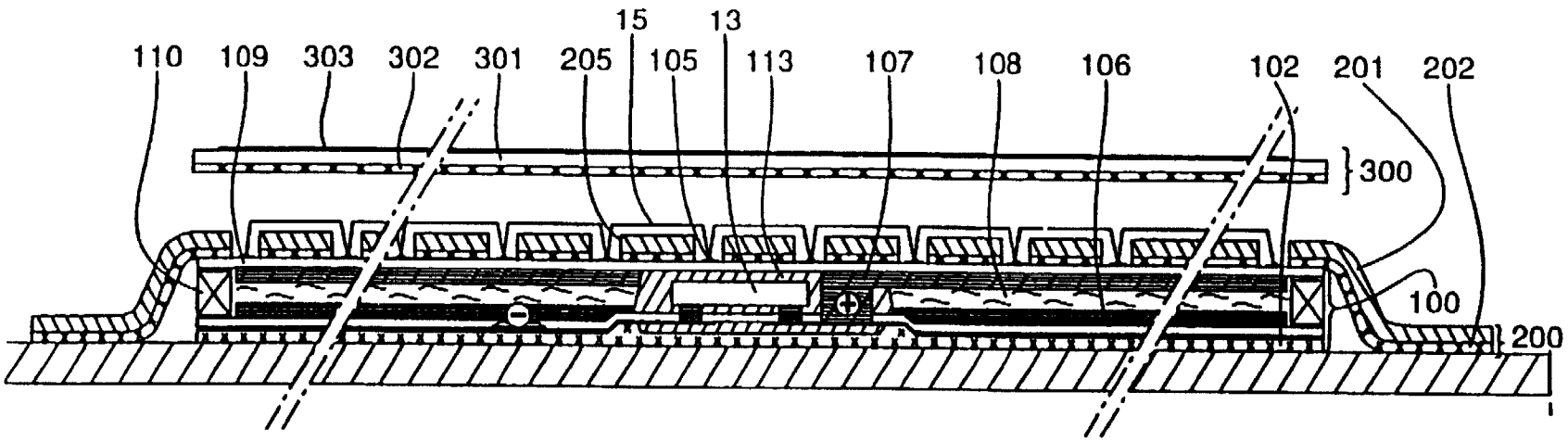
FIGS. 6 to 8 are sectional views of three other embodiments of the label according to the invention.
Figure 7:
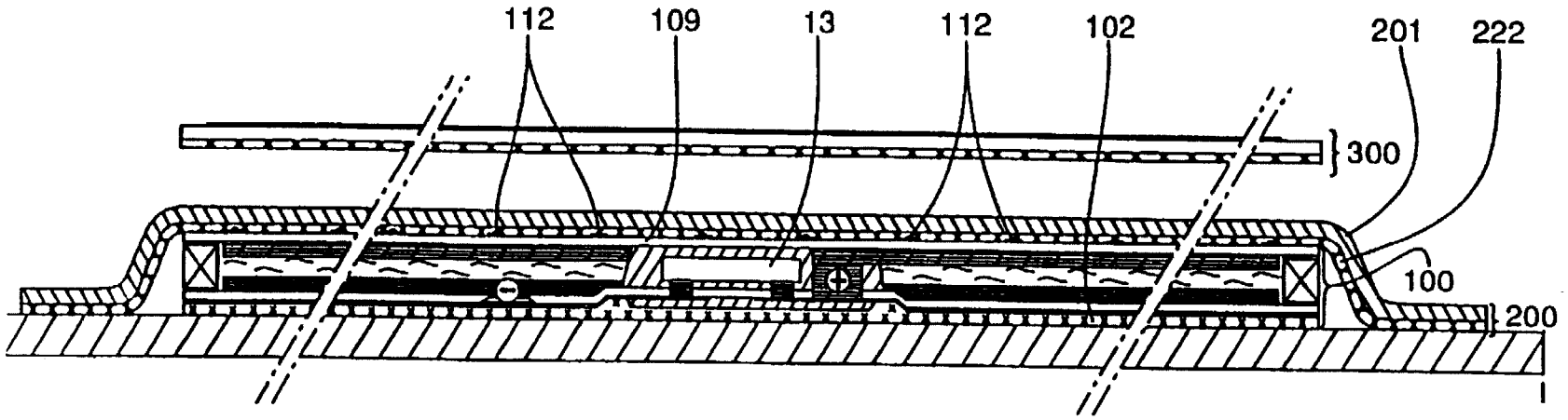
Figure 8:
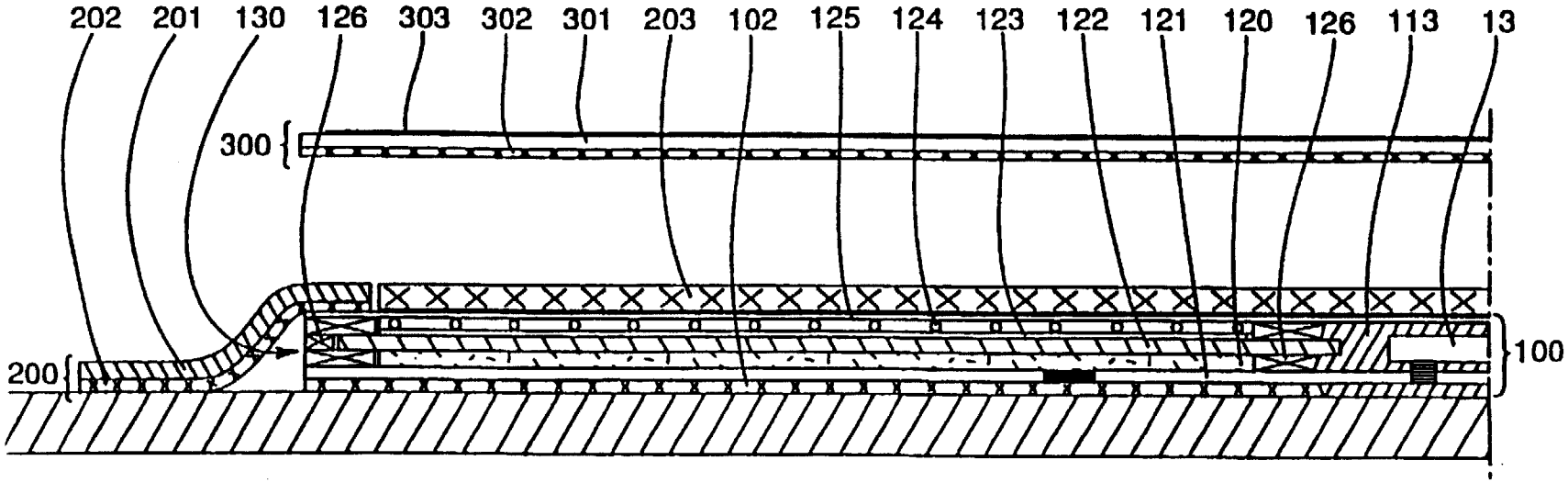

FIGS. 6 to 8 show further embodiments of markers according to the invention comprising an energy supply means in the bottom layer 100. This energy supply means can be a single means or plural means depending on the degree of protection required.

The electronic module 13 is, in a known manner, protected by an add-on moulded stub 113, e.g. in plastic.

As represented in FIG. 6, the bottom layer 100 is shaped so as to form an electrochemical couple and comprises a cathode 106 and an anode 107 separated by an electrolyte 108. For instance, this electrochemical couple can be rechargeable of the type known as a Lithium accumulator with thin layered solid electrolyte. Such accumulators have a total thickness of 150 μm and are comprised of a cathode made from an active material, a polymer-carbon matrix, a polymeric electrolyte comprising polyoxyethylene and a lithium salt, and a lithium-metal anode.

The electrochemical couple is coated with a protective layer 109 onto which are soldered, at 105, the portions of the detector ring 15 passing through the apertures 205 of the peel-off layer 200.

A strut 110 is located on the periphery of the electrochemical couple to compensate the thicknesses and to ensure the tightness of the system by soldering to the layer 109 and substrate of the adhesive 102.

The detection can sense rupture of the continuity of a circuit as described above, but can also sense a modification of the electric characteristics of a different type of detecting means.

In the embodiment represented in FIG. 6 described above, the electronic module can be programmed to monitor the voltage supplied by the electrochemical couple. This arrangement transmits an alarm to the surveillance services if the thief succeeds in gripping the bottom layer 100 after having removed the part protruding from the peel-off layer 200 and before this peel-off layer 200 is separated from the bottom layer 100, thereby breaking the detector ring 15.

As the adhesive 102 bonding the bottom layer 100 to the object to be protected is a strong adhesive, any attempted tearing off of said bottom layer 100 causes destruction of the electrochemical couple. The electronic module then observes a drop in the voltage at its terminals and emits an alarm.

When several energy sources are used, a higher degree of security is obtained by detecting the voltage drop of the destroyed source by means of another energy source that has remained intact.

FIG. 7 represents an embodiment of the label according to the invention in which the detecting means is comprised by the adhesive film 222 disposed on the peel-off layer 200 and metallized stubs 112 of the bottom layer 100.

In this form of embodiment, the adhesive 222 used is a conductive adhesive. This adhesive 222 is positioned on the metallized stubs, or contacts, 112 and ensures electric continuity between these stubs. This continuity is modified or broken when the peel-off layer 200 is removed from the bottom layer 100. When the electronic module remarks this modification, it transmits an alarm signal to the monitoring means.

In these two embodiments in which the energy source is permanently connected to the electronic module, the stand-by operation of the label, i.e. outside of alarm transmissions, during which the the module can interact with or signal its presence to the surveillance systems, requires very little energy. The current needed to maintain stand-by operation of the electronic circuit is less than one microampere, and this is the equivalent of the leakage current of the electrochemical couple.

FIG. 8 represents a third embodiment of the label according to the invention in which the fraud detecting means is comprised by the electrochemical couple itself.

To this end, the electrochemical couple 130 is of the metal/air type. Such electrochemical couples work by deoxidation of the cathode and oxidation of the anode.

The cathode, known as an air cathode, is comprised of three elements:

a hydrophobic porous layer 125 of which one side is aerated while the other side is in contact with an aqueous electrolyte. The layer is permeable to air but impermeable to the aqueous electrolyte in order to avoid any outward leakage of the latter;

a porous current collector 124 with which the electric current can be extracted from the electrochemical couple and led to the external utilisation circuit;

an active layer 123 that can be depolarized by oxygen, constituted e.g. by active carbon which can receive a catalyzer, associated with a fine-particled hydrophobic polymeric material, all incorporated into the current collector.

Various types of anodes may be used, and mention might be made of the following by way of examples: zinc, aluminium, aluminium alloy or magnesium anodes.

In known metal/air electrochemical couples, the electrolyte has a neutral pH for low-consumption applications, or a highly alkaline one when high output is required.

FIG. 8 shows the bottom layer 100, peel-off layer 200 and top layer 300 of the label embodying the invention.

The bottom layer 100 comprises, as above, the electronic module 13 protected by the moulded add-on stub 113.

The metal/air electrochemical couple is comprised of an anode 120, a separator 122 and an air cathode, 123, 124, 125.

The anode 120 is a metal anode of the type described above, and can be formed from a metal powder compressed against the separator during the manufacturing of the electrochemical couple. An anode current collector 121 electrically connects the electrochemical couple to the electronic module, and is e.g. comprised of a two-sided flexible printed circuit with metallized filled holes.

The outer metallized side of said printed circuit can include other elements of the electronic module such as a transceiving antenna, an energy receiving coil, a layered capacitor, etc.

The separator 122 is made from a material that can be wet by the electrolyte. It can e.g. be made from one of the following materials: cellophane, PVC-treated nylon wool (marketed as ACROPOR WA), microporous polypropylene (marketed as CELGARD), polyethylene and PVC (marketed as PERMION), PVC-treated cellulose (marketed as VISCON), acrylic copolymer (marketed as DYNEL), glass fibers, natural fibers, asbestos, etc.

The air cathode is comprised of an active layer that can be depolarized by oxygen 123, a porous current collector 124 and a hydrophobic layer 125 permeable to oxygen.

The active layer 123 is a mixture of active carbon and a hydrophobic material such as polyethylene, polypropylene or a carbon fluoride. It is obtained by compression. The current collector 124 is comprised of a metal such as nickel or stainless steel in the form of a grid or screen. The hydrophobic layer 125 enables the oxygen to pass towards the active layer 123 while preventing the electrolyte from leaking outwards.

Intermediate plies 126 are disposed on both sides of the separator 122 to ensure the cohesion and tightness of the accumulator.

The peel-off layer 200 can, as represented in the drawing, comprise a porous layer 203 ensuring oxygen is diffused towards the air cathode. This layer is located between the air cathode and the top layer 300, when the latter exists, and is not affixed by bonding so as to be very easily lifted off when the peel-off layer 200 is removed during attempted tearing off of the label, and is passed through by the ambient air when said layer 300 is lacerated.

In known manner per se, the various elements comprising the metal/air cell are made integral with one another by creating a depression inside said cell. This type of set-up enables the ambient air to be aspirated and the metal/air cathode to be brought into contact with the oxygen by a lifting up of the porous layer 203 or laceration of the decorative layer 300, causing very speedy activation of the electrochemical couple.

In this form of embodiment, the alarm is given by the electronic module as soon as it remarks that the metal/air cell has been activated and is supplying current.

A label of this type does not enable fraudulent passing to be detected if the label has not been deteriorated, nor does it enable interrogation of the electronic module as long as the battery has not been activated. These types of uses can be obtained by providing an additional means such as an energy receiving antenna.

The labels embodying the invention enable, as described above, detection of attempted tearing off by the modification of a detecting means located between the peel-off layer 200 and the bottom layer 100. They also enable detection of attempted destruction of the label by laceration. In this case, the electronic module detects a modification in the electronic circuit which can be materialized, depending on the form of the embodiment of the label, by rupture of the detector ring 15, a modification in the conductivity between two stubs 112 due to deterioration of the adhesive layer 222, a drop in the voltage at the terminals of one of the energy sources while the latter is still operating, or a supply of energy to the terminals of the metal/air cell brought about by the introduction of air between the layers 200 and 100 in the case of the metal/air accumulator.

The current means for manufacturing the various elements used in the marker embodying the invention enable the providing of a semi-rigid device less than 700 micrometers thick, which makes it very easy to use.

Figure 9:
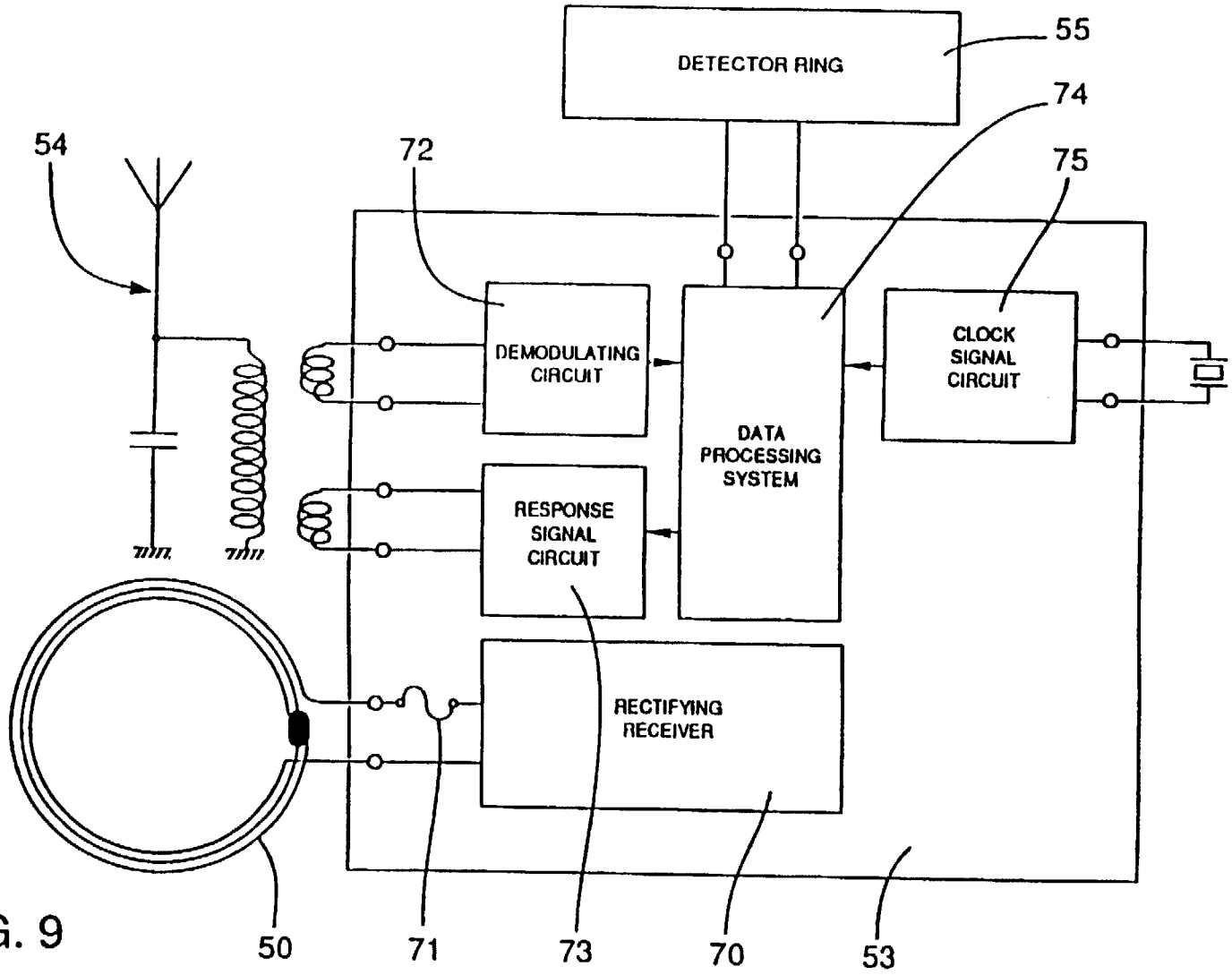
FIGS. 9 and 10 show two sample embodiments of the electronic circuit of the marker.
Figure 10:
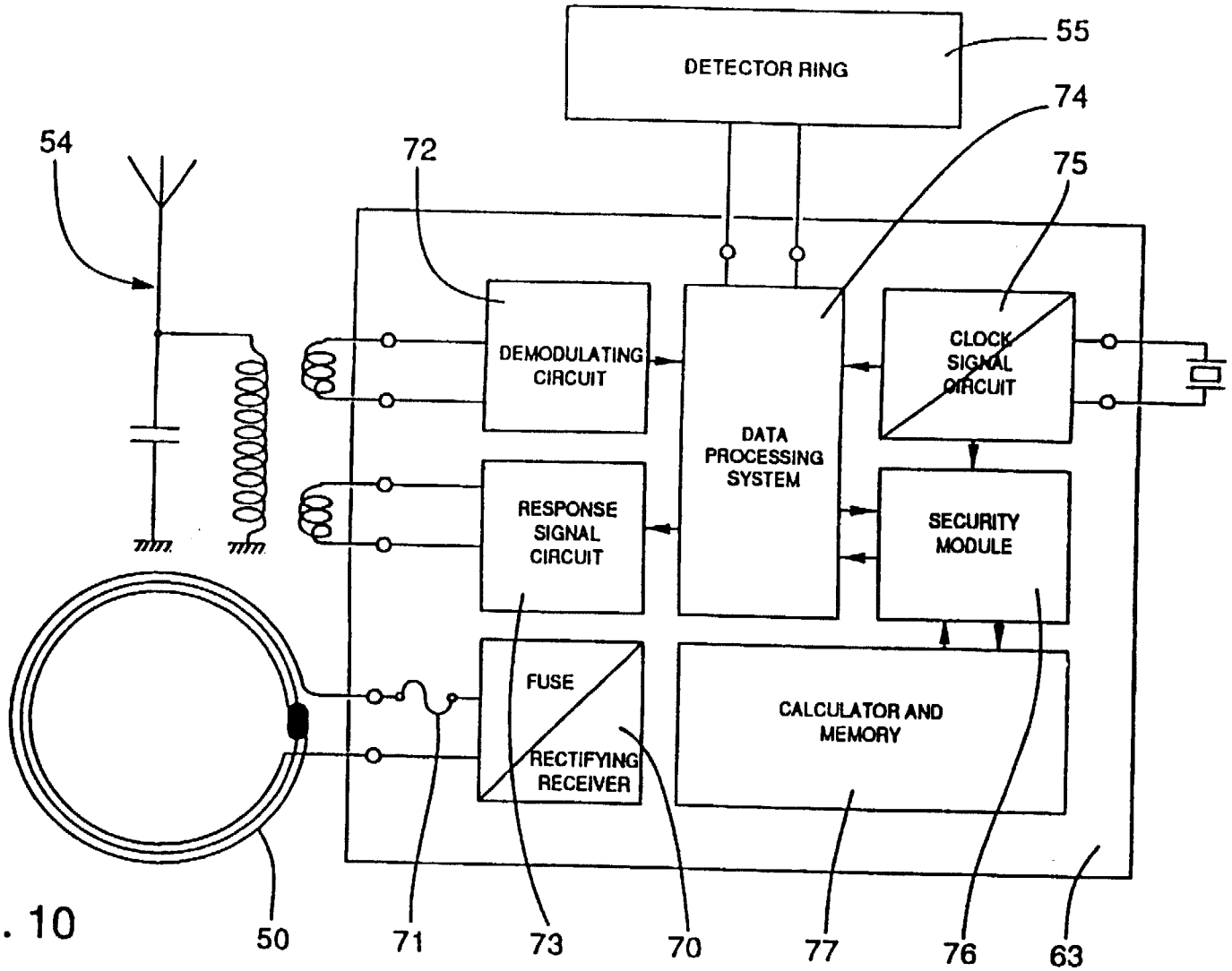

FIGS. 9 and 10 show two embodiments of the electronic circuit of the markers embodying the invention.

In said drawings, the electronic component used is shown by the frame 53 or 63.

The detector ring 55 feeds marker-status data to said electronic component which is connected via the antenna 54 to a surveillance system.

In the non-limiting examples of embodiments in these FIGS. 9 and 10, a single antenna transceives the messages on the same carrier frequency.

In the examples represented, a coil 50 feeding power to the electronic module may consist of the detector ring or of any other coil part of the marker, e.g. the antennas 14 of FIGS. 3 and 5.

This power is rectified and stabilized in the rectifying receiver 70.

A fuse 71 is located between the coil 50 and the rectifying receiver 70.

A circuit 72 receives and demodulates the data picked up by the antenna 54 and transmits these data to a data processing system 74.

Said data processing system 74 also receives a clock signal from the circuit 75.

Based on the data received either from the receiving and demodulating circuit 72 or from the detector ring 55, said data processing system 74 feeds an output signal to the circuit 73, said output signal then being modulated and transmitted by the antenna 54.

When such a marker passes through the surveillance system's transceiving antennas located at the exit from the surveillance zone, it will receive from said surveillance system a call signal e.g. in the form of a carrier-frequency modulation.

The data processing system 74 identifies this call signal and triggers a response signal from the circuit 73.

Said call and response signals can, of course, be coded e.g. by using different modulating frequencies.

When an attempt is made to tear the marker from its substrate, the data processing system 74 receives this information from the detector ring 55 and triggers the transmission of a signal.

In a third case, namely when the item is brought to the cash register by a purchaser, substantial energy is applied, as a result of which the fuse 71 is destroyed.

The embodiment in FIG. 10 differs from that of FIG. 9 in that it comprises a security module 76 consisting of a calculator and a memory 77 which can be accessed solely by said module.

This latter embodiment allows interaction between the surveillance system and the label. The memory may contain data specifically relating to the item, the store, etc.

We claim:

1. A marker intended to be detected when it passes through surveillance zones, and emitting an alarm signal as soon as an attempt is made to remove it from the article to which it is attached, of the type comprising an electronic circuit with an electronic module and a detecting means (15, 122, 130) of which one electric, chemical or electrochemical feature is modified when an attempt is made to remove said marker from the article to which it is attached, and an electronic module (13) capable of detecting the modification in the detecting means and of informing monitoring means thereof, characterized in that it comes in the form of an adhesive label comprising a bottom layer (100) bearing a first adhesive (102) by way of which it is applied to the article to be protected, and a peel-off layer (200) fixed to the bottom layer (100) by a second weaker adhesive (202) with lower tear resistance than said first adhesive (102) in order to ensure that said second adhesive (202) yields first when an attempt is made to remove the label from the article to which it is attached, thereby leading to a tearing of the peel-off layer (200) while the bottom layer (100) remains fastened to the article, and in that the detecting means (15, 122, 130) is located between the peel-off layer (200) and the bottom layer (100) so that its electric, chemical or electrochemical feature is modified when the peel-off layer (200) is removed.

2. Marker as claimed in claim 1, characterized in that the electronic module (13) and the vital elements needed to communicate with the monitoring means are located in the bottom layer (100) in order to remain on the article after the label has been destroyed and to continue to protect it by enabling the surveillance systems to locate the article or to identify it at the exits from the enclosure.

3. Marker as claimed in claim 2, characterized in that it comprises a means supplying energy to the electronic circuit, and in that this means is situated in the bottom layer (100).

4. Marker as claimed in claim 1, characterized in that the detecting means is a loop of conducting wire (15) located on the non-adhesive upper side of the peel-off layer (200), and which passes through apertures (205) in said peel-off layer (200) to be made integral at (105) with the bottom layer (100).

5. Marker as claimed in claim 1, characterized in that the detecting means is constituted by the adhesive film (222) located on the peel-off layer (200), the adhesive film (222) being a conducting adhesive ensuring electric continuity between a plurality of stubs (112) borne by the bottom layer (100), whose electric continuity is broken when the peel-off layer (200) is removed from the bottom layer (100).

6. Marker as claimed in claim 3, characterized in that the detecting means is comprised of an electrochemical couple (130), said electrochemical couple (130) being of the metal/air type and being activated and supplying energy to the electronic module (13) by being brought into contact with air when the peel-off layer (200) is removed from the bottom layer (100).

7. Marker as claimed in claim 1, characterized in that it comprises a top layer (300) formed of a substrate (301) and an adhesive (302) to affix it to the peel-off layer (200), this layer (300) protecting the detecting means and being susceptible of presenting commercial data such as the sale price or a decoration.

8. Marker as claimed in claim 1, characterized in that it comprises fuses which can be destroyed by a destruction signal induced in the electronic circuit.

9. Marker as claimed in either of claims 1 and 2, characterized in that a capacitor (103) forms an energy storage means, said capacitor (103) being susceptible of being housed between the substrate (101) and the first adhesive (102).

10. Marker as claimed in claim 7, characterized in that the vital elements, e.g. the energy source or the antenna, are duplicated in order to protect the label against attempted destruction by scratching or laceration of the top layer (300).

* * * * *

UNITED STATES PATENT AND TRADEMARK OFFICE

CERTIFICATE OF CORRECTION

PATENT NO. : 5,767,772

DATED : June 16, 1998

INVENTOR(S) : Gerard LEMAIRE et al.

It is certified that error appears in the above-identified patent and that said Letters Patent is hereby corrected as shown below:

On the title page: Item [63]

--This is a continuation-in-part of U.S. Serial No. 08/357,550, Filed December 15, 1994.--

--Claim of priority - French Patent Application NO. 93 15063, Filed December 15, 1993.--

Signed and Sealed this

Tenth Day of November 1998

*Attest:*

*Attesting Officer*

BRUCE LEHMAN

*Commissioner of Patents and Trademarks*